US011180271B2

(12) United States Patent
Oettinger

(10) Patent No.: US 11,180,271 B2
(45) Date of Patent: Nov. 23, 2021

(54) COMPRESSING MATTRESSES TO REDUCE VOLUME WITHOUT CAUSING PERMANENT DAMAGE

(71) Applicant: The Furniture Recycling Group Limited, Blackburn (GB)

(72) Inventor: Nicholas Simon Oettinger, Preston (GB)

(73) Assignee: THE FURNITURE RECYCLING GROUP LIMITED, Blackburn (GB)

( * ) Notice: Subject to any disclaimer, the term of this patent is extended or adjusted under 35 U.S.C. 154(b) by 90 days.

(21) Appl. No.: 16/548,895

(22) Filed: Aug. 23, 2019

(65) Prior Publication Data

US 2020/0062437 A1 Feb. 27, 2020

(30) Foreign Application Priority Data

Aug. 23, 2018 (GB) ..... 1813746

(51) Int. Cl.
*B65B 63/02* (2006.01)

(52) U.S. Cl.
CPC ..... *B65B 63/02* (2013.01)

(58) Field of Classification Search
CPC ..... B65B 13/20; B65B 63/02; B65B 35/50
See application file for complete search history.

(56) References Cited

U.S. PATENT DOCUMENTS

| | | | | |
|---|---|---|---|---|
| 1,887,226 A | | 11/1932 | Wunderlich | |
| 2,309,795 A | | 2/1943 | Siegel | |
| 2,696,164 A | | 12/1954 | Droll | |
| 2,973,090 A | | 2/1961 | Dunlap | |
| 3,797,654 A | | 3/1974 | Spiller | |
| 3,805,354 A | | 4/1974 | Guthrie | |
| 4,065,910 A | * | 1/1978 | Eiselt | B65B 63/02 53/438 |
| 4,953,344 A | * | 9/1990 | Wallace | B65B 63/02 53/528 |
| 2009/0293431 A1 | * | 12/2009 | Andria | B65B 13/20 53/438 |
| 2012/0102884 A1 | | 5/2012 | Roberts, Jr. | |
| 2013/0145939 A1 | * | 6/2013 | Nissen | B65B 63/02 100/35 |
| 2019/0329966 A1 | * | 10/2019 | Vadlja | B65B 13/20 |

FOREIGN PATENT DOCUMENTS

WO 2011006229 A1 1/2011

OTHER PUBLICATIONS

Corresponding Great Britain patent application No. GB1813746.3, Search Report dated Feb. 5, 2019.

* cited by examiner

*Primary Examiner* — Anna K Kinsaul
*Assistant Examiner* — Himchan Song
(74) *Attorney, Agent, or Firm* — Cooper Legal Group, LLC

(57) ABSTRACT

Mattresses are stacked, with support surfaces being substantially in contact, to produce a mattress stack (201). A press (501) applies pressure in the direction of said mattress stack, such that said pressure is normal to the support surfaces and consistent with pressure applied by a reclining body, thereby resulting in reversible compression to form a compressed mattress stack. Restraining elements (601) restrains the mattress stack and the process may be repeated to increase the size of the stack.

18 Claims, 18 Drawing Sheets

COMPRESSING MATTRESSES TO REDUCE VOLUME WITHOUT CAUSING PERMANENT DAMAGE

CROSS REFERENCE TO RELATED APPLICATIONS

This application claims priority from United Kingdom Patent Application number 1813746.3, filed on Aug. 23, 2018, the whole contents of which are incorporated herein by reference.

BACKGROUND OF THE INVENTION

The present invention relates to an apparatus for compressing mattresses to reduce volume without causing permanent damage. The present invention also relates to a method of compressing mattresses to reduce volume without causing permanent damage.

It is known to compress spring subassemblies of mattresses to reduce the volume occupied by these products. Spring subassemblies may be compressed by a rolling or baling operation performed at the end of a recycling process. Thus, spring subassemblies, consisting exclusively of steel components with all fabric removed, may be compressed and rolled; given that any subsequent recycling operations will be conducted within a metal recycling facility. However, techniques of this type when deployed against complete mattresses, cause significant damage to internal components of the mattress which creates substantial difficulties within a mattress recycling facility.

Thus, known techniques for compression may be deployed when a mattress is to be directed towards landfill but known techniques for compression should not be deployed when mattresses are being stored or transported for recycling purposes. Furthermore, the compressing of new mattresses to reduce volume to facilitate transportation is only possible if the compression can be achieved without introducing permanent damage. A problem therefore exists in terms of how to compress a complete mattress for storage or transportation purposes to a significant degree, without causing permanent damage.

BRIEF SUMMARY OF THE INVENTION

According to a first aspect of the present invention, there is provided a method of compressing mattresses to reduce volume without causing permanent damage, comprising the steps of: stacking a plurality of mattresses, with support surfaces being substantially in contact, to produce a mattress stack; applying pressure substantially in the direction of said mattress stack, such that said pressure is normal to the support surfaces and consistent with pressure applied by a reclining body, thereby resulting in reversible compression to form a compressed mattress stack; and restraining said compressed mattress stack.

In an embodiment, the restraining step includes the application of a temporary restraining device during a compression process.

According to a second aspect of the present invention, there is provided an apparatus for compressing mattresses to reduce volume without causing permanent damage, comprising: a compression device; and a transportation frame, wherein: said transportation frame is arranged to receive a mattress stack of mattresses stacked with support surfaces in contact to a predetermined height; and said compression device is configured to apply additional mattresses, compress said additional mattresses in a direction substantially normal to said support surfaces to produce a compressed-mattress stack and restrain said compressed-mattress stack by restraining elements.

Embodiments of the invention will be described, by way of example only, with reference to the accompanying drawings. The detailed embodiments show the best mode known to the inventor and provide support for the invention as claimed. However, they are only exemplary and should not be used to interpret or limit the scope of the claims. Their purpose is to provide a teaching to those skilled in the art. Components and processes distinguished by ordinal phrases such as "first" and "second" do not necessarily define an order or ranking of any sort.

DETAILED DESCRIPTION OF EMBODIMENTS OF THE INVENTION

FIG. 1

Figure 1:
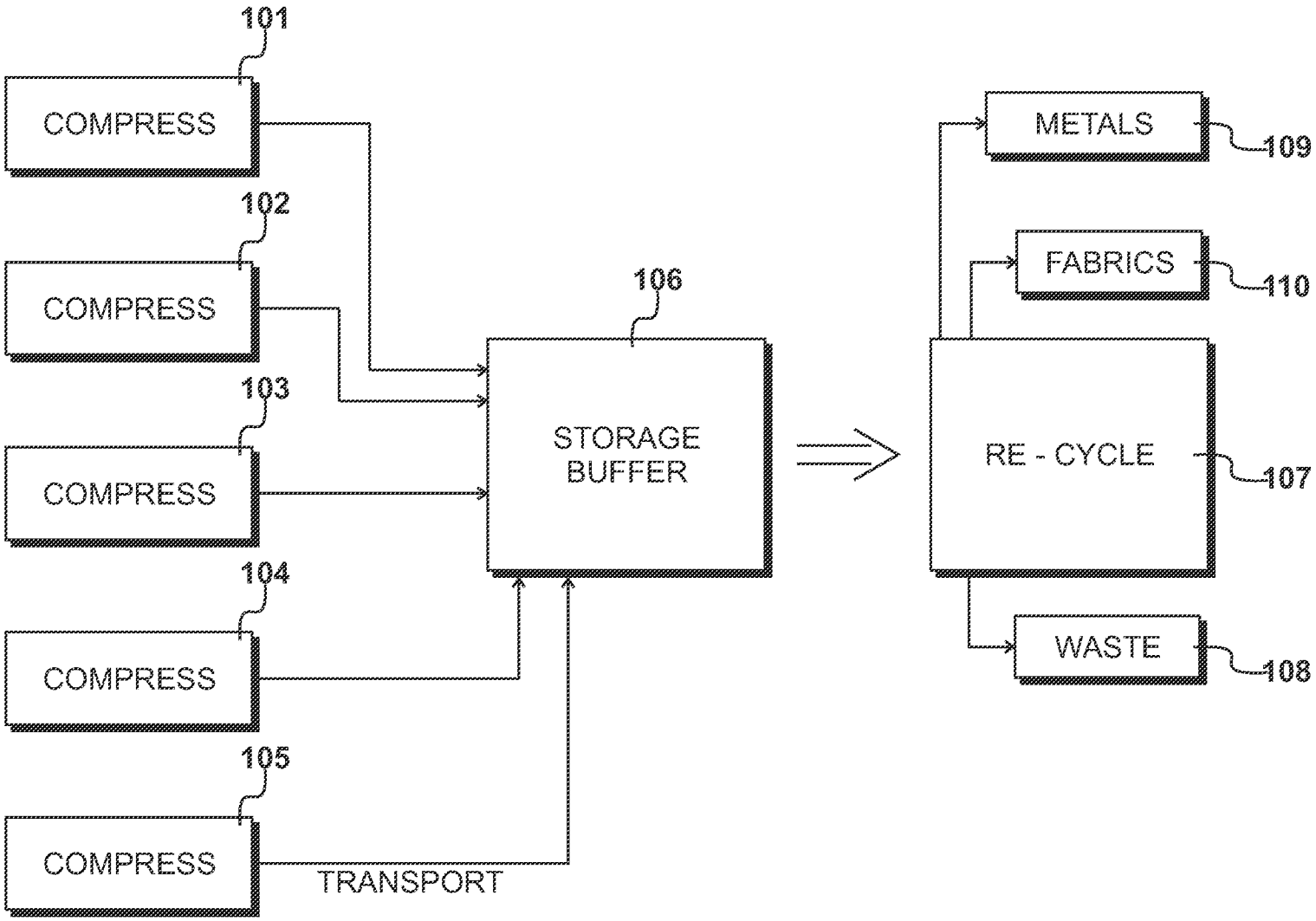
FIG. 1 shows an environment for the collection, storage and recycling of mattresses.

An environment for the collection, storage and recycling of mattresses is illustrated in FIG. 1. The environment includes collection facilities and, in FIG. 1, a first collection facility 101 is shown, along with a second collection facility 102, a third collection facility 103, a fourth collection facility 104 and a fifth collection facility 105. In a typical deployment, a collection facility could be operated by a local council or could be supported by a particular retailer, allowing the retailer to remove and recycle old mattress when new ones are being supplied.

In the environment of FIG. 1, mattresses are transported from the collection facilities to a storage buffer 106 implemented as a warehousing facility close to a recycling plant 107. An aim of the operator of the recycling plant 107 is to maintain continual operation of the plant, therefore the plant requires a continual stream of old mattresses from the storage buffer.

The majority of mattresses continue to be made from springs and as a result of this, they tend to retain their original shape. Articulated lorries (typically 40 feet in length) are used to transport used mattresses from collection facilities to the storage buffer 106. In a lorry of this type, it is possible to get eighty to one-hundred-and-twenty mattresses loaded, with the resulting weight of the load being relatively low for a vehicle of this type. Consequently, the cost per unit mile is relatively high, placing limits on the length of acceptable transportation links between collection facilities and the storage buffer 106. Consequently, in order to reduce the length of these transportation links, it would be necessary to have relatively many recycling plants receiving old mattresses from relatively few collection facilities. However, to make better use of recycling plants, it would be preferable for them to receive discarded mattresses from a larger geographical area, requiring a greater number of collection facilities but incurring significantly more transportation miles.

Bailing machines are known that roll mattresses up and then apply a retaining device, such as a plastic sock, to retain the mattresses in a rolled state. However, this approach distorts the shape of the mattress, making it difficult to recycle. For example, in order to strip a mattress, the mattress itself must be laid flat. However, after being rolled, it is not possible to obtain the original flat configuration.

Many mattresses have a boarder rod with pocket springs or open coil springs. These boarder rods are either flat or cylindrical but once distorted, the whole mattress becomes distorted, making it difficult to recycle economically. Thus, any savings made by the compression of mattresses in this way is lost, due to the additional costs involved in terms of recycling them.

The present embodiment aims to compress mattresses to an extent that, for example, allows five-hundred to five-hundred-and-fifty mattresses to be carried by a single lorry, that previously could only carry eighty to one-hundred mattresses. However, this is achieved in a way that does not cause permanent damage, such that the process may be reversed and the recycling operations performed as if the mattress had not been compressed.

Thus, in the environment of FIG. 1, compression takes place at each of the collection facilities 101 to 105, thereby allowing significantly more mattresses to be transferred to the storage buffer 106. The mattresses are stored in their compressed configuration at the storage buffer 106 until they are required by the recycling plant 107. This allows substantially more mattresses to be held at the storage buffer 106.

Experience shows that a significant number of mattresses appear for recycling during the winter months, with this number reducing thru the summer. Thus, it is possible for an average mattress feed to be calculated and for the recycling plant to be optimized for this available feed. Fluctuations thru-out the year are then buffered by the storage buffer 106.

It is appreciated that the recycling plant 107 must produce some waste 108 but an aim of the recycling plant operator is to reduce this as far as possible. Thus, materials are recovered from the recycling process, including metals 109 and fabrics 110.

FIG. 2

Figure 2:
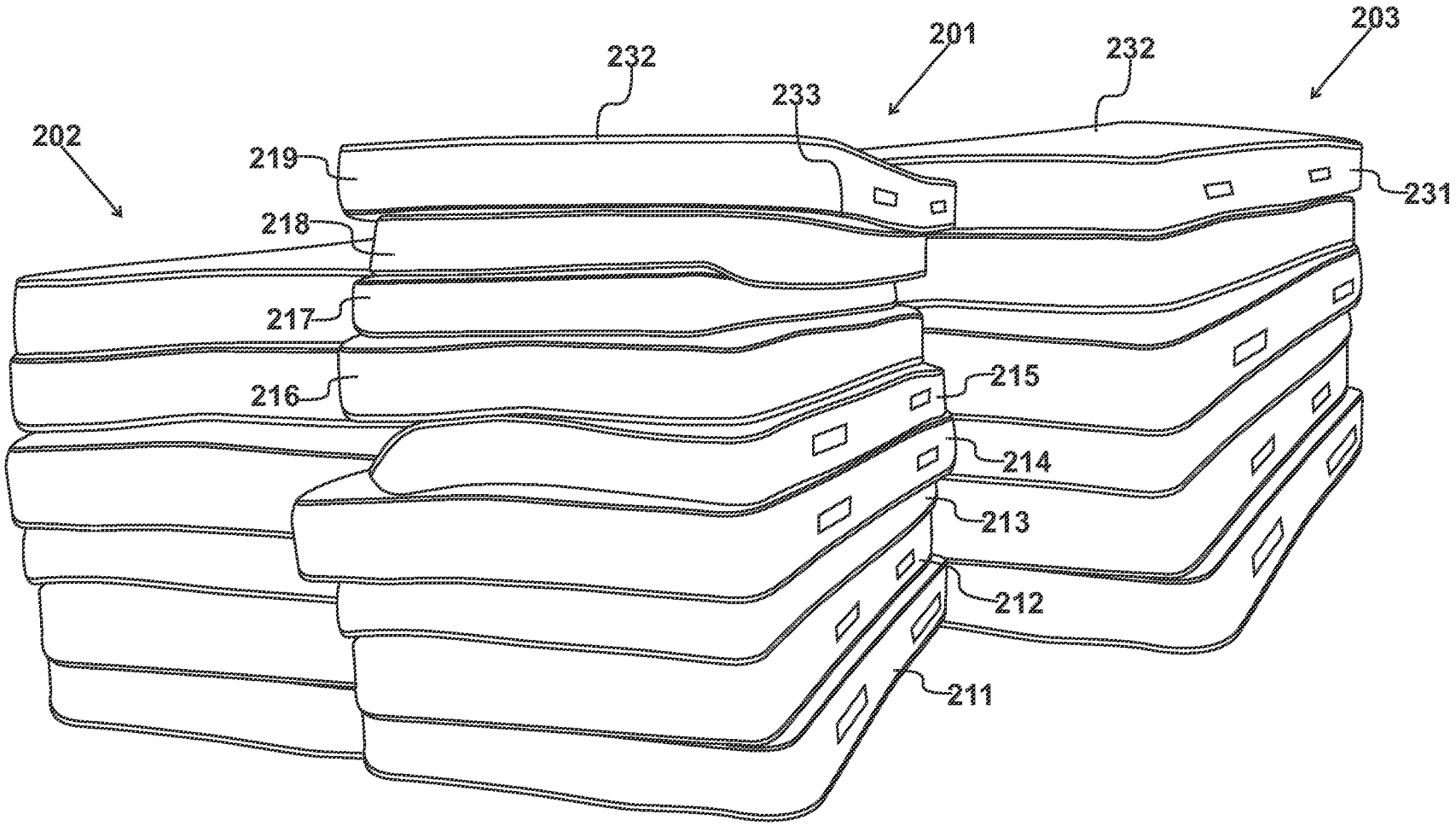
FIG. 2 shows non-compressed stacks of mattresses.

A collection facility, such as the first collection facility 101, is illustrated in FIG. 2, having received discarded mattresses for recycling purposes. The mattresses are initially stored in non-compressed stacks. Thus, a first mattress stack 201 includes a first mattress 211, a second mattress 212, a third mattress 213, a fourth mattress 214, a fifth mattress 215, a sixth mattress 216, a seventh mattress 217, an eighth mattress 218 and a ninth mattress 219. The first collection facility also includes a second mattress stack 202 and a third mattress stack 203. Thus, it can be seen that a relatively low number of mattresses quickly start to take up a significant amount of space within the first collection facility 101.

Each mattress has edge portions 231 connecting a larger upper support surface 232 and a similar lower support surface. As shown in FIG. 2, stacking involves placing support surfaces of adjacent mattresses substantially in contact.

FIG. 3

Figure 3:
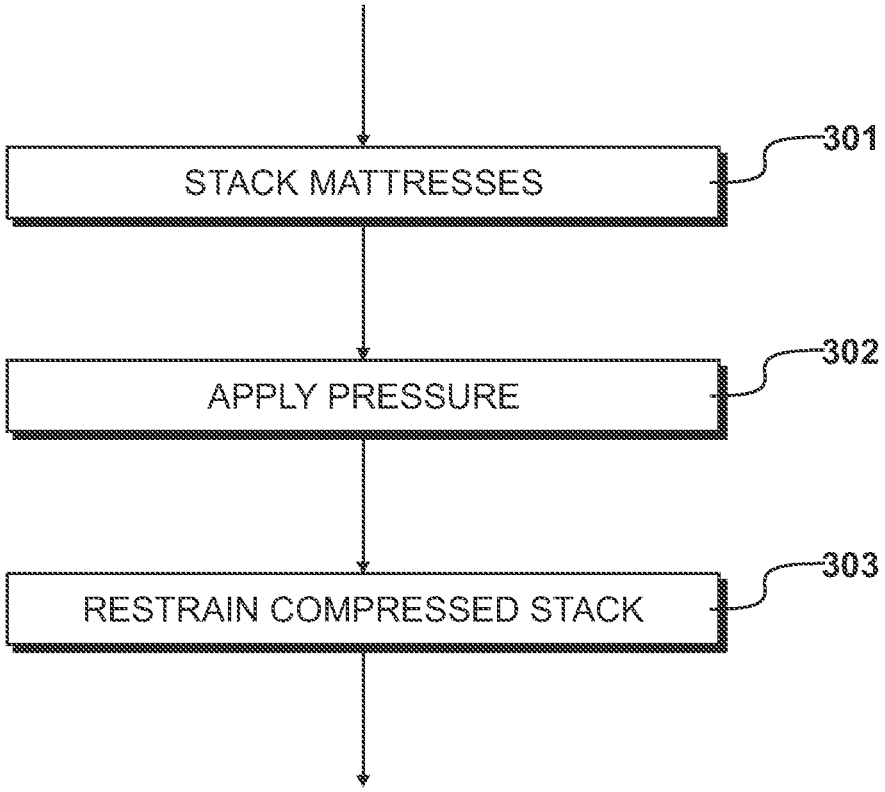
FIG. 3 illustrates a method of compressing mattresses.

In an embodiment, a method is performed of compressing mattresses to reduce volume without causing permanent damage, as illustrated in FIG. 3.

At step 301, mattresses are stacked, with support surfaces being substantially in contact, to produce a mattress stack.

At step 302, pressure is applied substantially in the direction of the mattress stack, such that this pressure is normal to the support surfaces and is consistent with the pressure that would have been applied by a reclining body, thereby resulting in a reversible compression to form a compressed mattress stack.

Thereafter, at step 303, the compressed mattress stack is restrained. In this way, it is possible for a restrained and compressed mattress stack to be transported from the first collection facility 101 to the storage buffer 106. Furthermore, in this compressed and restrained form, it is possible for the mattress to be stored at the storage buffer 106 until required by the recycling plant 107. In an embodiment, the restraining step includes the application of a temporary restraining device during a compression process. This is then replaced with a permanent restraining device for transportation and storage.

FIG. 4

A first method of compressing mattresses to reduce volume without causing permanent damage will be described with reference to FIGS. 4 to 8.

Figure 4:
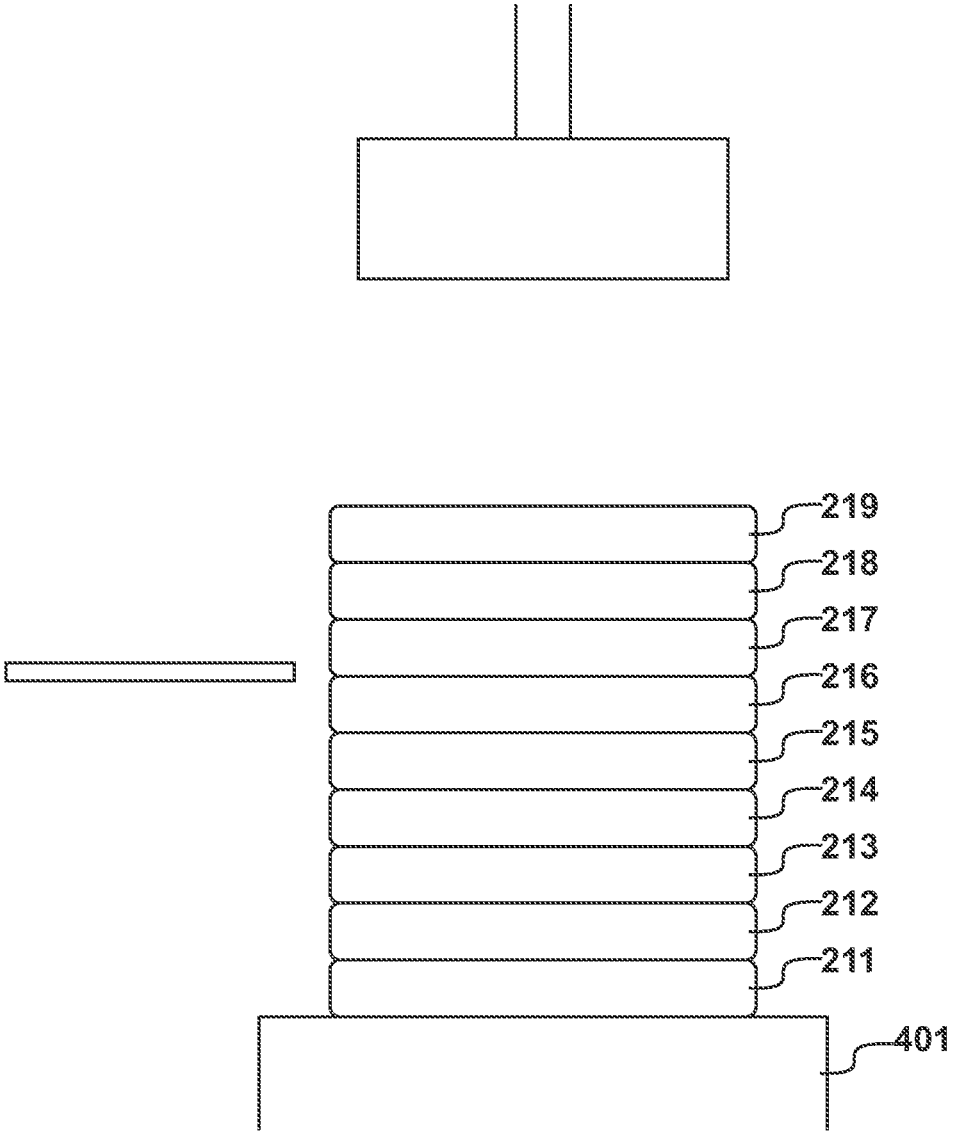
FIG. 4 shows a first stage of mattress compression.
Figure 5:
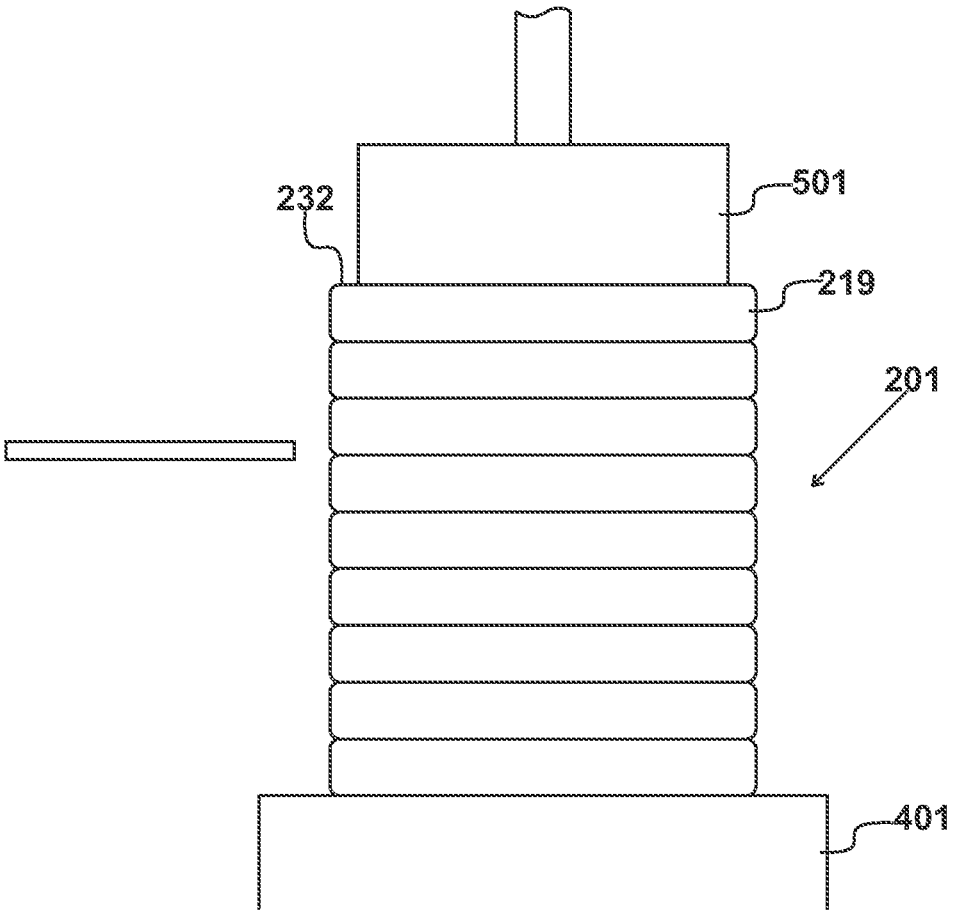
FIG. 5 shows a second stage of mattress compression.

A base 401 receives uncompressed mattresses. To facilitate transportation of mattresses within the collection facility, the mattresses are transported in groups of three. Thus, in this way, mattresses 211 to 219 of the first mattress stack 201 are transported onto the base 401, as illustrated in FIG. 4.

FIG. 5

After assembling the mattress stack 201, as described with reference to FIG. 4, a compression device, in the form of a compression press 501, is brought down on top of the upper support surface 232 of the top mattress 219. Thus, no further mattresses may be added at this point and the stack 209 is retained in place without experiencing any pressure being applied thereto.

FIG. 6

After aligning the compression press 501, pressure is applied to compress the mattress stack 201 to a height that is slightly below the position of a retaining device 601.

FIG. 7

Figure 6:
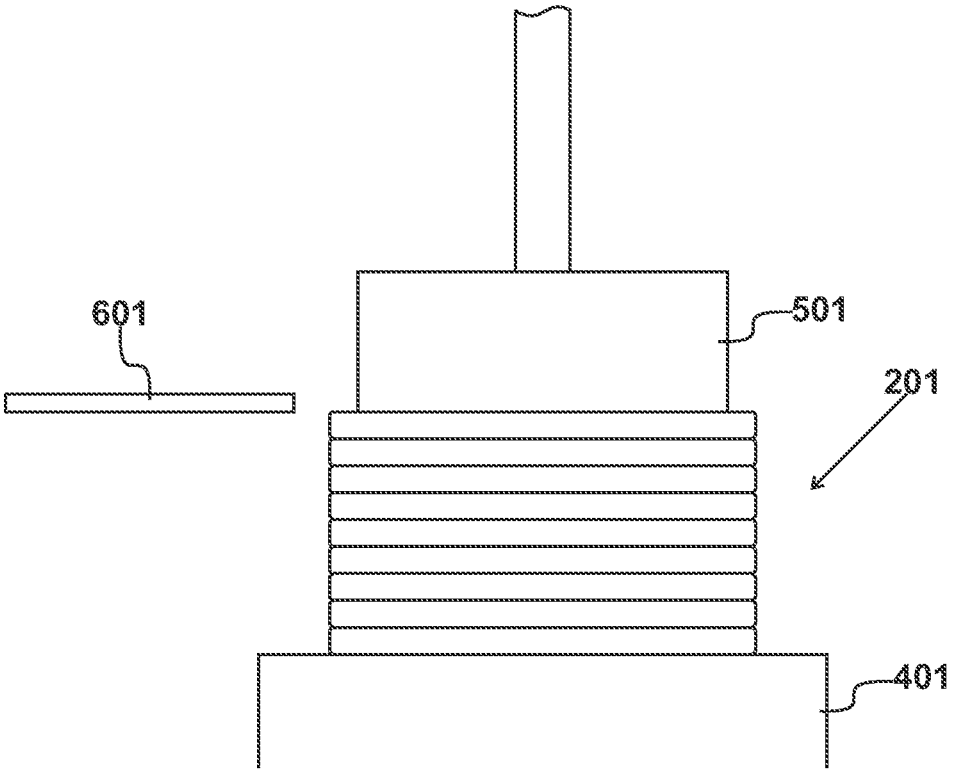
FIG. 6 shows a third stage of mattress compression.

After compressing the mattress stack, as described with reference to FIG. 6, the retaining device 601 is moved in the direction of arrow 701, to retain the compressed mattress stack in place. The retaining device 601 is received within grooves forming part of the compression press 501, thereby allowing the retaining device 601 to be inserted while the compression press 501 remains in place.

FIG. 8

Figure 7:
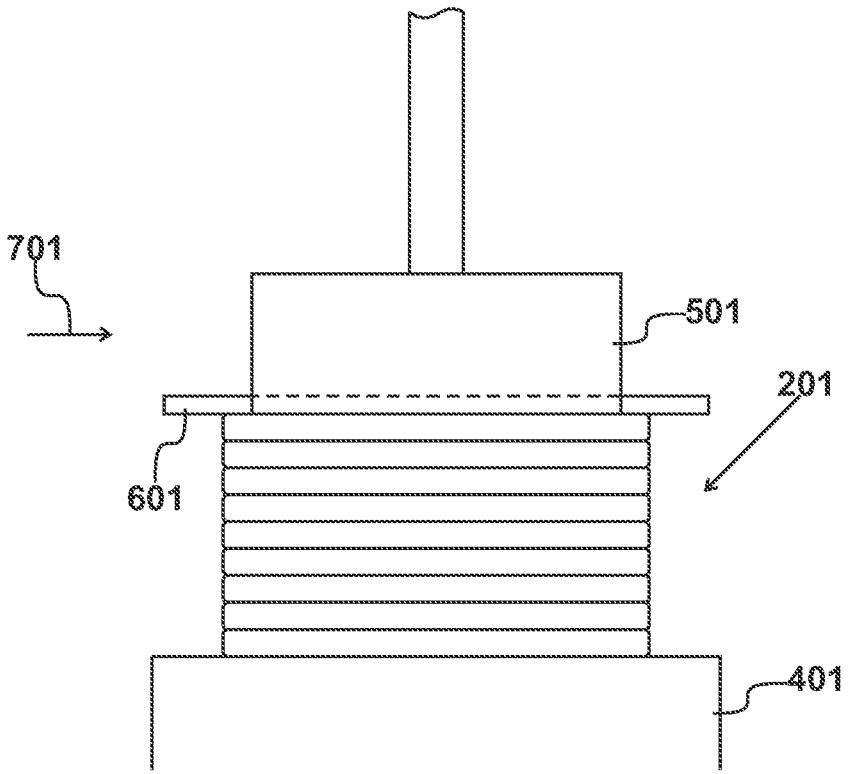
FIG. 7 shows a fourth stage of mattress compression.

With a compressed mattress stack retained in place by the retaining device 601, as described with reference to FIG. 7, the press 501 now retracts, in the direction of arrow 801, back to the position illustrated in FIG. 4.

The compression procedure as described with references to FIGS. 3 to 8, provides a degree of compression that allows nine mattresses to occupy the space previously taken by six. However, given the construction of the mattresses, it is possible to achieve a greater level of compression without causing permanent damage. However, transportation within the facility is easier if the mattresses can be moved in groups of no more than three. Thus, a further embodiment seeks to achieve a higher level of compression while accepting the constraints of only transporting a limited number of uncompressed mattresses in any one movement.

FIG. 9

Figure 9:
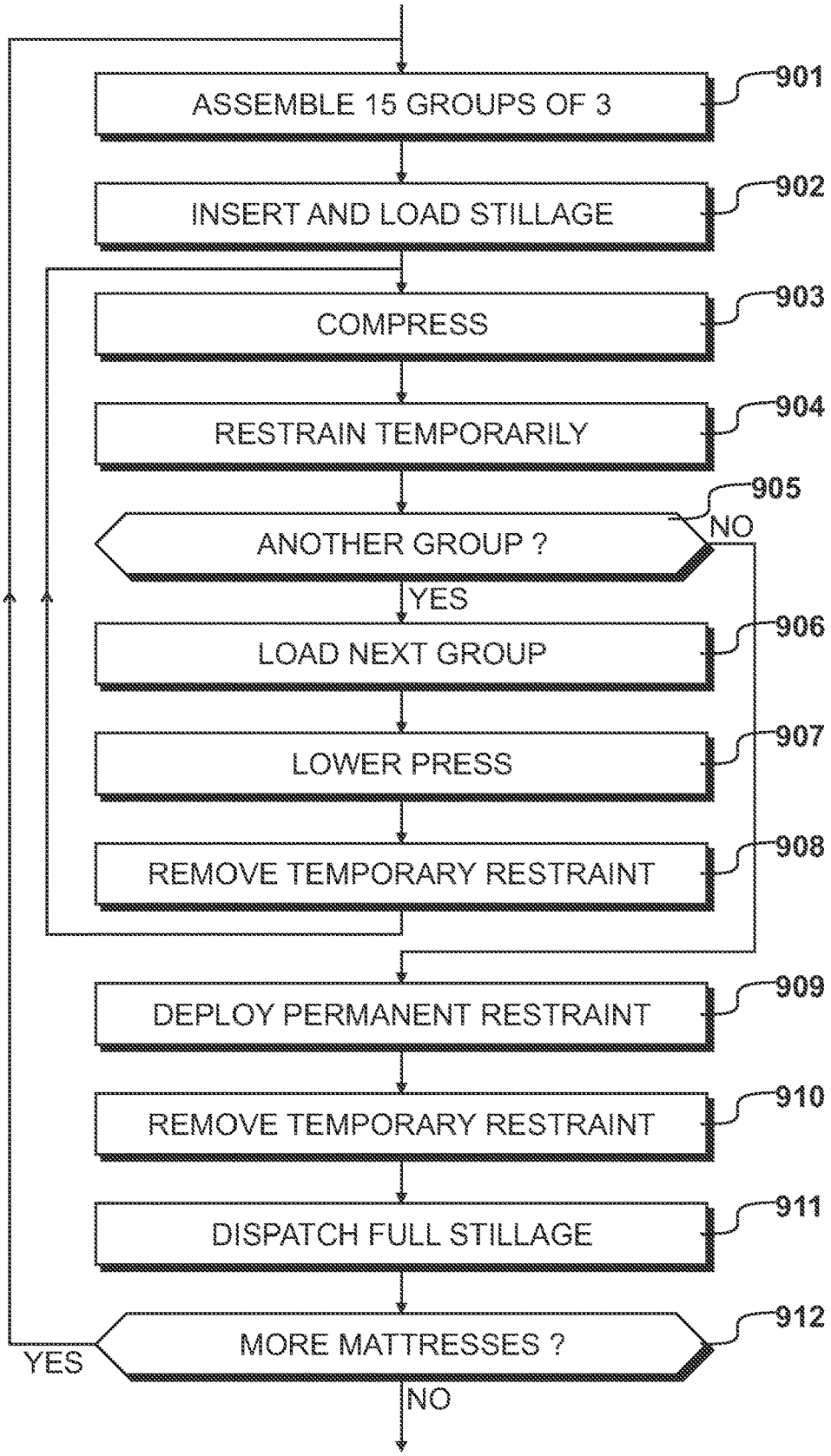
FIG. 9 shows an enhanced procedure for compressing mattresses.

An enhanced procedure for compressing mattresses to reduce volume without causing permanent damage is illustrated in FIG. 9. At step 901, the mattresses are assembled into groups and compression then takes place on a group-by-group basis. In this embodiment, each group includes three mattresses to be compressed and a compression cycle involves fifteen of these groups, thereby compressing forty-five mattresses into the space usually occupied by six. However, it should be appreciated that in alternative configurations, alternative group sizes and different numbers of groups may be deployed.

At step 902, a stillage is inserted within the compression apparatus and, in this embodiment, six non-compressed mattresses (effectively two groups of three) are initially loaded into the stillage. It is likely that each collection facility would be provided with a single compression apparatus that remains resident. In addition, each collection facility would receive many stillages, which may be in a folded form to minimize their volume when not in use. The local compression apparatus is then used to compress mattresses within the stillages. When a sufficient number of stillages have been used, they are loaded onto a lorry and transported to the storage buffer 106.

In an embodiment, each stillage, when assembled, provides an empty steel frame with forklift truck locations at its bottom. In an embodiment, it is possible for the stillage to collapse down, to occupy significantly less volume. Thus, in this way, many empty stillages may be transported and dropped off.

In use, a stillage is lifted into place by a fork lift truck. A door of the compression apparatus is closed and delivery conveyers are provided to the side of the compression apparatus for receiving the uncompressed mattresses.

In an embodiment, the stillages also have feet on the bottom and nubs on the top, thereby allowing them to be stacked two high. In this way, it is possible for a trailer to receive twelve of these stillages, each typically containing forty-five mattresses, thereby allowing a total of five-hundred-and-forty mattresses to be transported.

The stillages are designed to take the largest mattresses of six-by-six feet. In addition, this also allows single mattresses to be placed side-by-side but it is appreciated that some gaps will be present if smaller double mattresses are to be compressed. Other embodiments may be configured to take larger mattresses.

After the insertion and loading of the stillage at step 902, the configuration of the mattress stack is substantially similar to that shown in FIG. 4.

At step 903 the mattress stack is compressed. Thus, the press 501 is brought down, as described with reference to FIG. 5 and pressure is applied to compress the mattress stack as described with reference to FIG. 6. Thereafter, the retaining device 601 is moved in the direction of arrow 701, to retain the compressed stack, as described with reference to FIG. 7 and the compression press 501 is then retracted, as described with reference to FIG. 8. The compressed mattress stack is retained by the retaining device 601.

In this enhanced embodiment, the restraining device 601 is a temporary restraining device forming part of the compression apparatus. Thus, the compressed stack is restrained temporarily, as shown at step 904.

At step 905, a question is asked as to whether another group is to be compressed and when answered in the affirmative, the next group is loaded at step 906. At step 907, the press is lowered to restrain the mattresses and the temporary restraining device is then removed at step 908. Thereafter, step 903 is repeated to achieve further compression, followed by temporary restraint at step 904.

As the question asked at step 905 continues to be answered in the affirmative, further mattresses are loaded and further compression takes place until the question asked at step 905 has been answered in the negative. In this embodiment, fifteen groups of three mattresses will have been temporarily restrained before the question asked at step 905 is answered in the negative. Again, other embodiments may be designed to hold fewer or more mattresses.

When the question asked at step 905 is answered in the negative, a permanent restraint is deployed at step 909 and the temporary restraint is removed at step 910. The full stillage is then dispatched at step 911 and a question is then asked at step 912 as to whether more mattresses are to be compressed. Thus, when answered in the affirmative, further mattresses are assembled into groups at step 901.

FIG. 10

Figure 8:
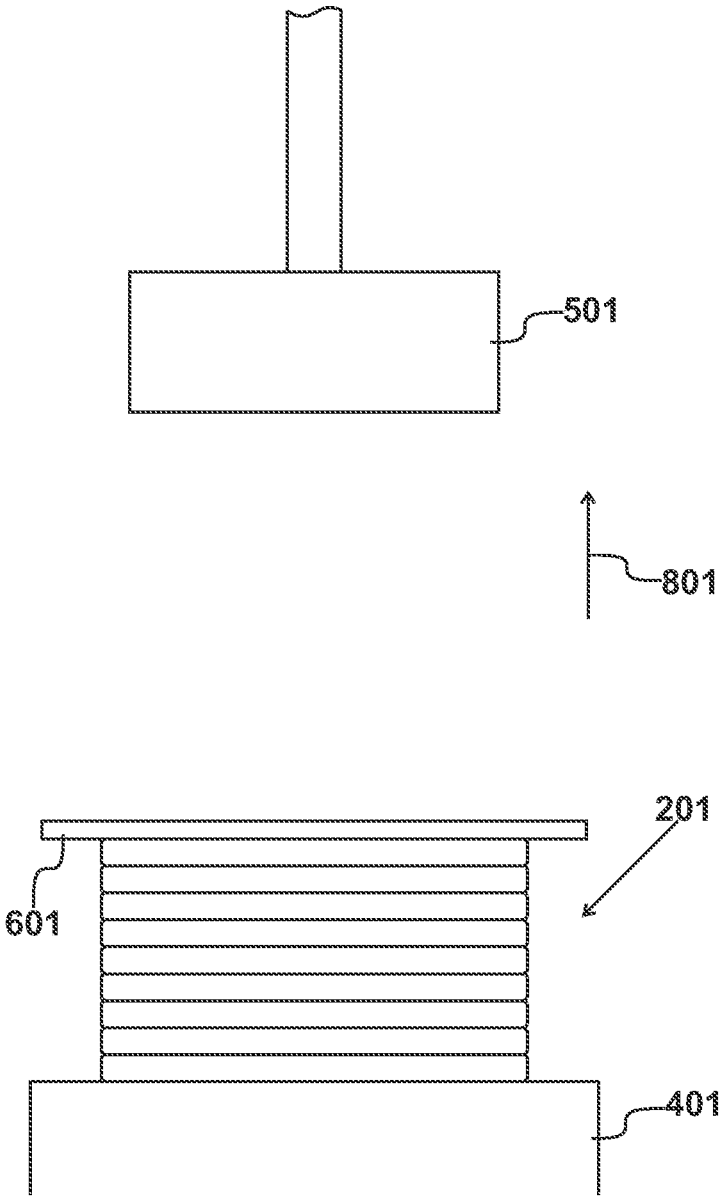
FIG. 8 shows a fifth stage of mattress compression.
Figure 10:
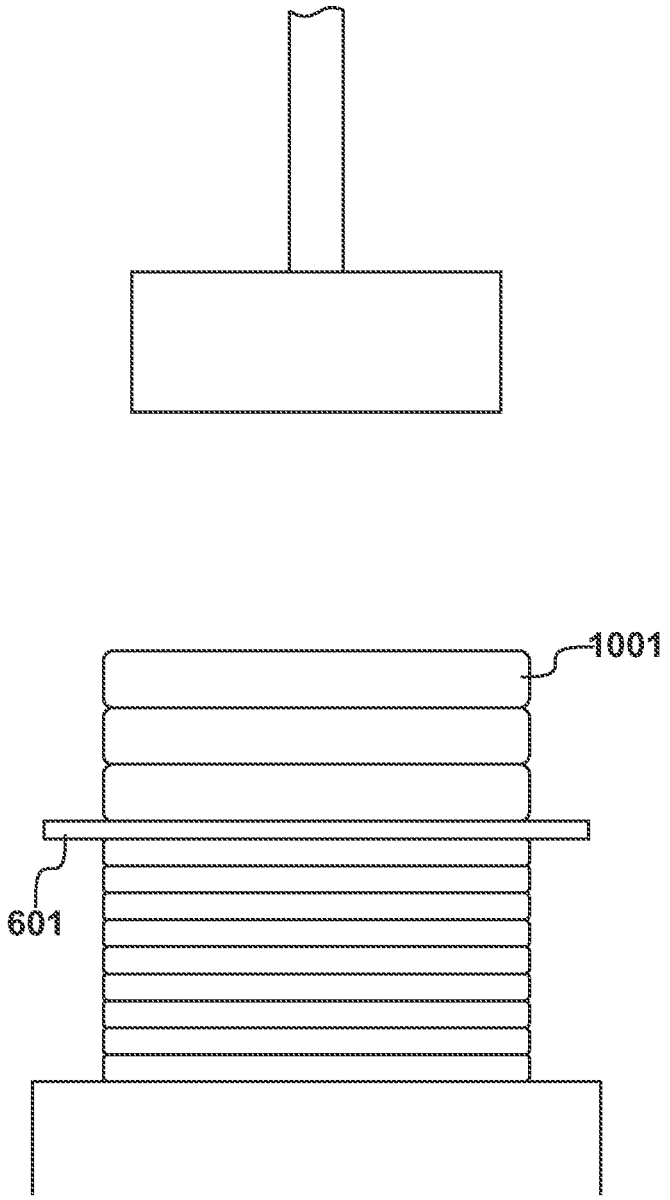
FIG. 10 shows a sixth stage of mattress compression.

On a first iteration of the procedure described with reference to FIG. 9, the compressed mattresses have been restrained temporarily at step 904, as illustrated in FIG. 8. Following the question asked at step 905 being answered in the affirmative, the next group of mattresses are loaded at step 906, as illustrated in FIG. 10. Thus, in this way, a next group 1001 of uncompressed mattresses has been loaded upon the temporary restraining device 601.

FIG. 11

Following the loading of the next group of mattresses 1001 upon the temporary retaining device 601, the press 501 is lowered in the direction of arrow 1101, following step 907.

FIG. 12

Following the deployment of the compression press 501 at step 907, the temporary restraining device 601 is retracted in the direction of arrow 1201, in accordance with step 908. Thus, the full enhanced compressed stack 1202 is retained by the compression press 501.

As previously described, a further cycle of compression is then performed, such that the press 501 is moved further in the direction of arrow 1203, to achieve a configuration sustainably similar to that described with reference to FIG. 6. The temporary retaining device is again activated, substantially as described with reference to FIG. 7, allowing the press 501 to be retracted, substantially as described with reference to FIG. 8. Thus, the next group of mattresses may be loaded as described with reference to FIG. 10 and the overall process repeated, until the question asked at step 905 is answered in the negative.

Thus, it can be seen that the method allows a third plurality of non-compressed mattresses to be placed upon the temporary restraining device, thereby allowing the compressing device to be brought into contact with this third plurality. The temporary restraining device is again retracted, allowing the compression device to further compress and thereby add the third plurality of mattresses to the first plurality of compressed mattresses. The temporary restraining device is again deployed to restrain the compressed mattresses and the compression device is again displaced away from the temporary restraining device, thereby allowing further mattresses to be introduced until a limit has been reached.

In an embodiment, the number of mattresses introduced for compression is preselected; irrespective of the actual thickness of the mattresses involved. In an alternative embodiment, the compression steps are repeated until a predetermined level of compression has been achieved and this predetermined level of compression may be determined by measuring the pressure of the compressed mattresses.

In this embodiment, the mattresses are supported within a transportable frame or stillage. The temporary restraining device forms part of the compression device and upon reaching a predetermined level of compression, the temporary restraining device is replaced by a permanent restraining device forming part of the transportable frame or stillage.

FIG. 13

Figure 13:
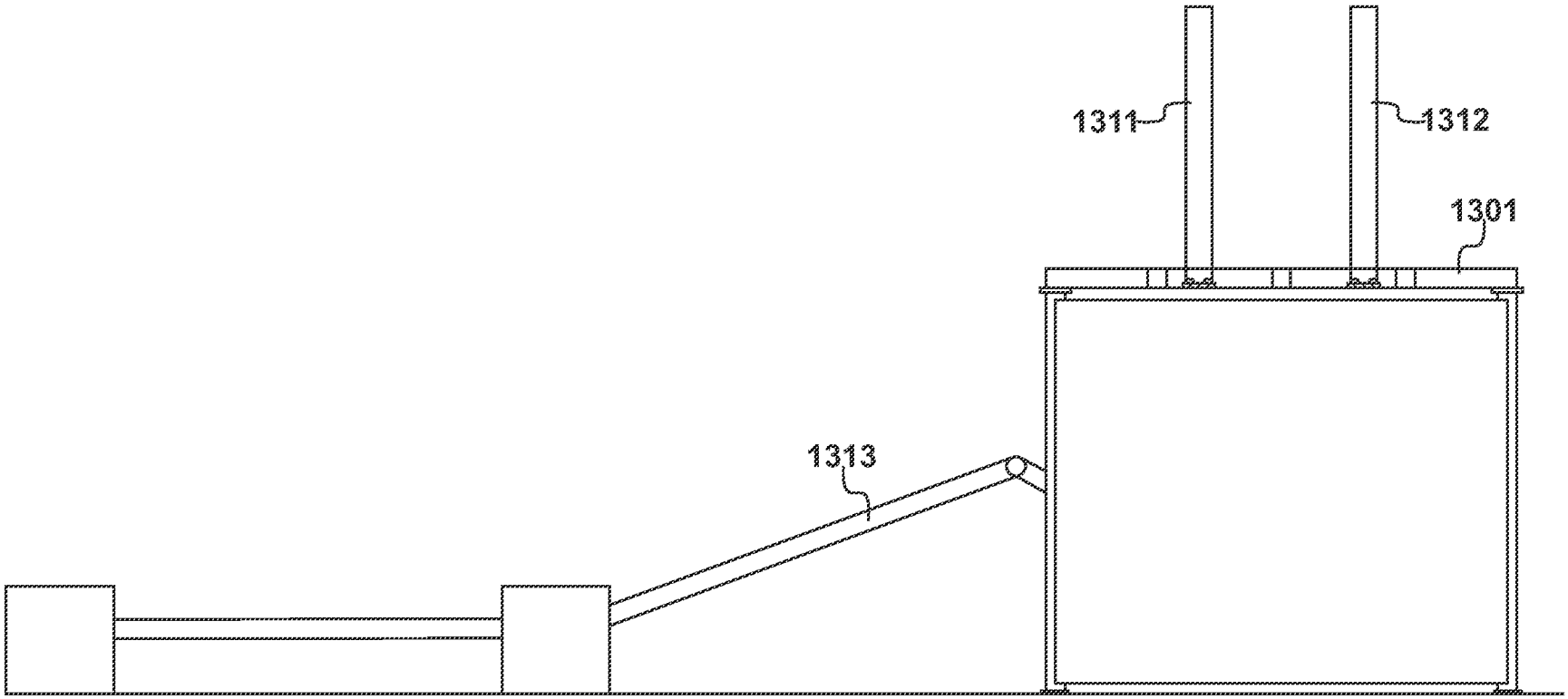
FIG. 13 shows an apparatus for compressing mattresses.

An apparatus is illustrated in FIG. 13 for compressing mattresses to reduce volume without causing permanent damage, by implementing the method described previously. Each mattress includes a first support surface, a second support surface and a surrounding edge, as previously described with reference to FIG. 2.

The apparatus comprises a compression device 1301 and transportation frames or stillages. In practice, a collection facility will be provided with at least one compression device 1301 and a plurality of transportation frames. Each transportation frame is arranged to receive a mattress stack of mattresses, stacked with support surfaces in contact to a predetermined height, substantially as described with reference to FIG. 4. The compression device is configured to apply additional mattresses and compress the additional mattresses in a direction substantially normal to the support surfaces to produce a compressed mattress stack, as previously described with reference to FIG. 6. This compressed mattress stack is then restrained by restraining elements, as described with reference to FIG. 7.

In this way, the compression device is configured to compress the mattress stack to the predetermined height, being the height just below that of the temporary restraining device 601, as described with reference to FIG. 6. Thereafter, the compression device is configured to repeatedly add non-compressed mattresses to the compressed stack.

The compression device 1301 has twin hydraulic shafts, implemented as a first hydraulic shaft 1311 and a second hydraulic shaft 1312. A conveyer 1313 receives a group (of three) mattresses and is then activated, such that the mattresses go up the conveyer and enter the compression device 1301 at an opening having a predetermined height. The mattresses are delivered onto the temporary retaining device, taking the form of parallel tubes at the top of the machine that are arranged to retract. These tubes locate within stillage holes present within the stillage, to provide the temporary restraint.

Initially, mattresses may enter the machine and rest of top of the tubes. The tubes are retracted, so that the first group of mattresses drop below the level of the tubes. The tubes then go back over to allow the second group of three mattresses to be placed on top of the tubes. Again, the tubes retract, such that the compression device now contains six mattresses, having a typical height of about one metre. A compression cycle is now performed, with three new mattresses being added to the six uncompressed mattresses currently in the stillage.

The tubes are inserted again and the next three mattresses slide on top of the tubes. At this stage, six mattresses are below the tubes and three mattresses are supported by the tubes. The press 501 comes down and touches the top of the mattresses, as described with reference to FIG. 5. The tubes retract but the pressure applied maintains the mattresses in position.

FIG. 14

Figure 14:
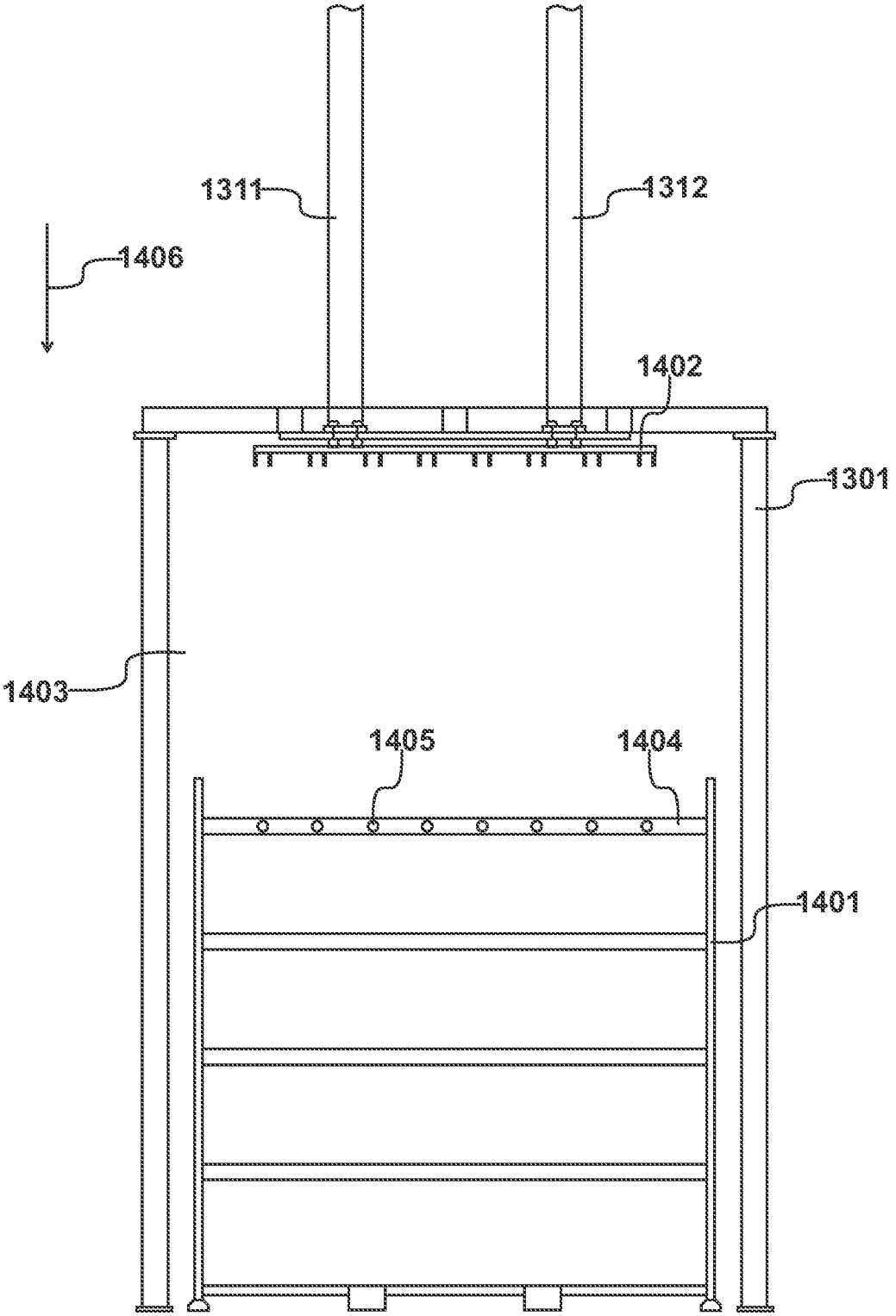
FIG. 14 details a compression device identified in FIG. 13.

The compression device 1301 is shown in FIG. 14, having received a stillage 1401. A compression platform 1402 is attached to the first hydraulic shaft 1311 and the second hydraulic shaft 1312. The compression platform 1402 is shown in its upper position, such that a reception space 1403 is provided below the compression platform 1402 to receive additional non-compressed mattresses.

The stillage 1401 includes horizontal side supports, including an uppermost horizontal side support 1404. The uppermost horizontal side support 1403 includes stillage holes 1405; with eight stillage holes being present in the embodiment illustrated in FIG. 14. The stillage holes 1405 are arranged to receive eight parallel retention tubes which provide the temporary restraining device 601.

In operation, six uncompressed mattresses are located within the stillage 1401 and a further three mattresses are then received within the reception space 1403, thereby providing a configuration substantially similar to that described with reference to FIG. 4. The compression platform 1402 is then operated to move downwards in the direction of arrow 1406. In this way, the compression platform 1402 is brought into contact with an upper surface of the mattress stack and thereafter applies compression to compress the mattresses into the stillage 1401.

FIG. 15

Figure 15:
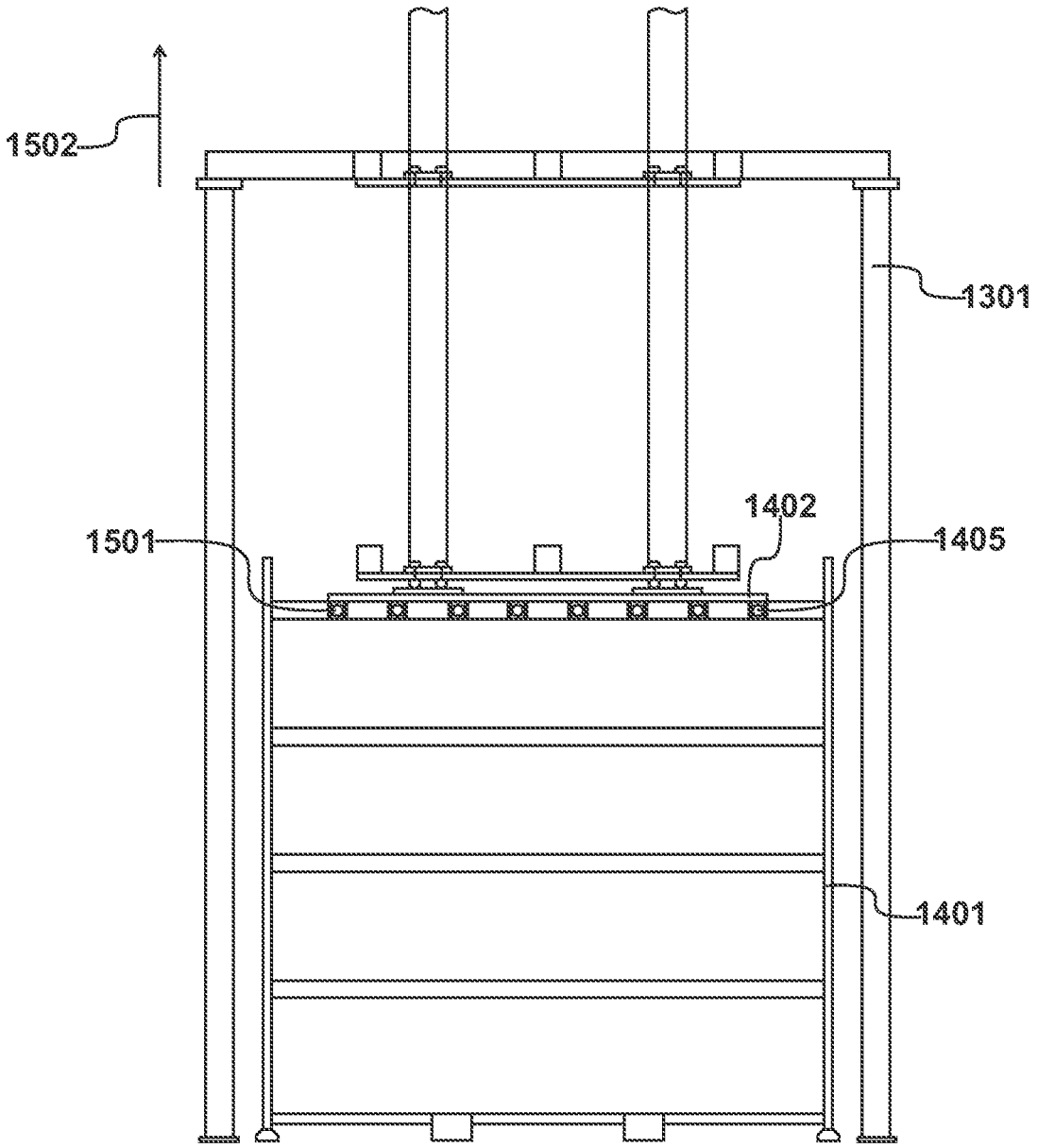
FIG. 15 shows the compression device of FIG. 14 in an alternative configuration.

The compression device 1301 is shown in FIG. 15, with the compression platform 1402 in its lower position; in a configuration substantially similar to that described with reference to FIG. 6. The bottom of the compression platform 1402 includes accommodation channels 1501, each of which is configured to align with a respective stillage hole 1405 when the compression platform 1402 is in its lower position. Thus, in this position, it is possible to insert the retention tubes while maintaining the mattresses in a compressed state within the stillage 1401. Thus, in the configuration shown in FIG. 15, each stillage hole 1405 receives a retention tube, of the type described with reference to FIG. 16. After the insertion of the retention tubes, the configuration is substantially similar to that described with respect to FIG. 7. Thus, it is now possible for the compression platform 1402 to move upwards in the direction of arrow 1502, thereby returning the compression platform 1402 back to its upper position, as described with reference to FIG. 14.

On a first iteration, nine mattresses have been compressed into the stillage that, in this example, has capacity for only six mattresses in a non-compressed state. However, as previously described, this process is repeated and, in an embodiment, it is possible to include forty-five compressed mattresses within the stillage.

Figure 11:
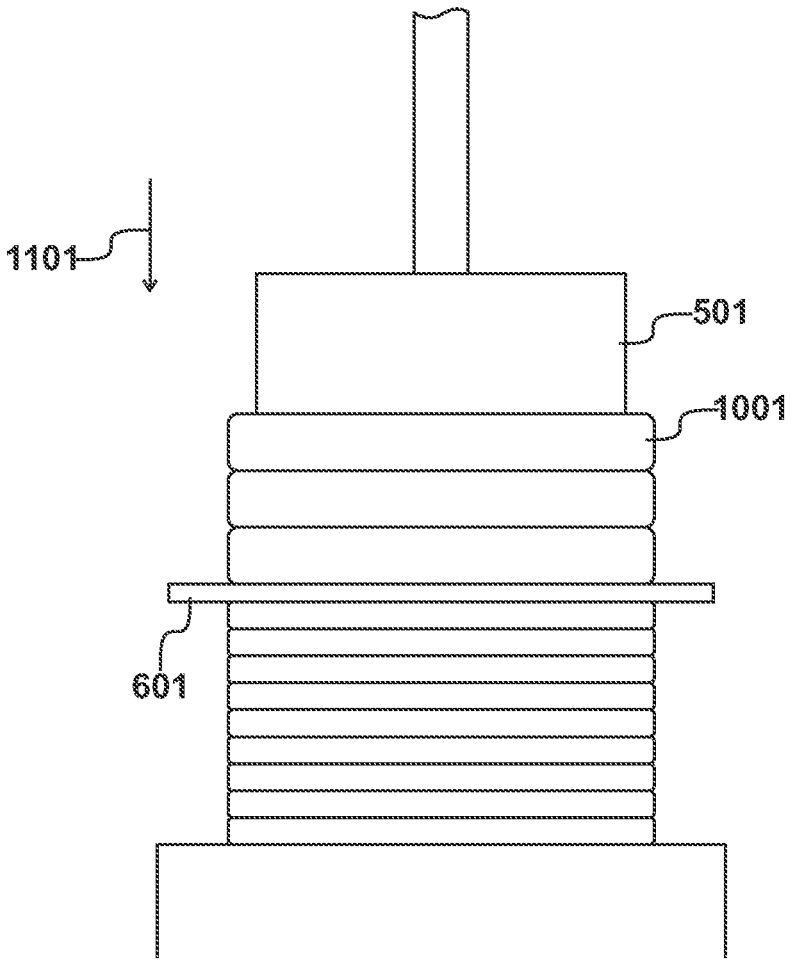
FIG. 11 shows a seventh stage of mattress compression.
Figure 12:
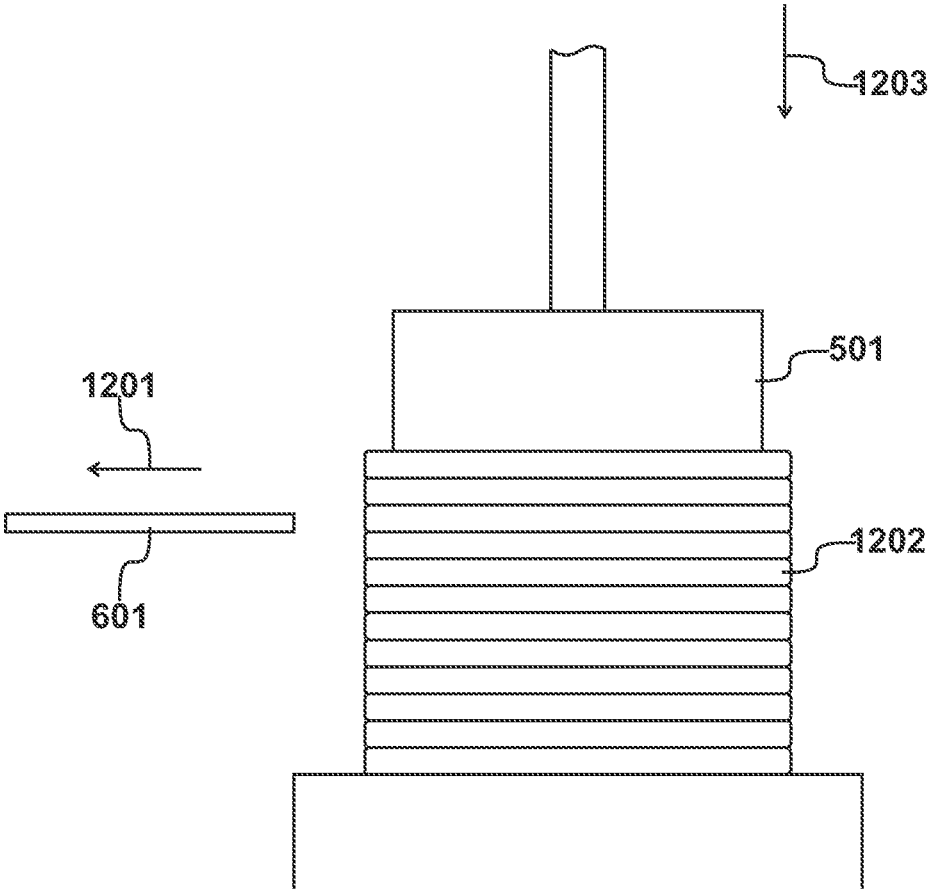
FIG. 12 shows an eighth stage of mattress compression.

Outer surfaces of the retention tubes are bright and smooth in an embodiment, to facilitate the introduction of additional uncompressed mattresses within the reception space 1403. This presents a configuration substantially similar to that described with respect to FIG. 10. The compression platform 1402 is then operated to move in the direction of arrow 1406, thereby adopting a configuration substantially similar to that described with respect to FIG. 11. Thereafter, the retention tubes are retracted from the stillage holes 1405, resulting in a configuration substantially similar to that described with respect to FIG. 12. Further compression is then conducted until the compression platform 1402 reaches its lower position, resulting in a further three mattresses being compressed within the storage space of the stillage. Thereafter, with the mattresses retained by their temporary retaining device, the compression platform 1402 is returned to its upper position, as described with reference to FIG. 14.

FIG. 16

Figure 16:
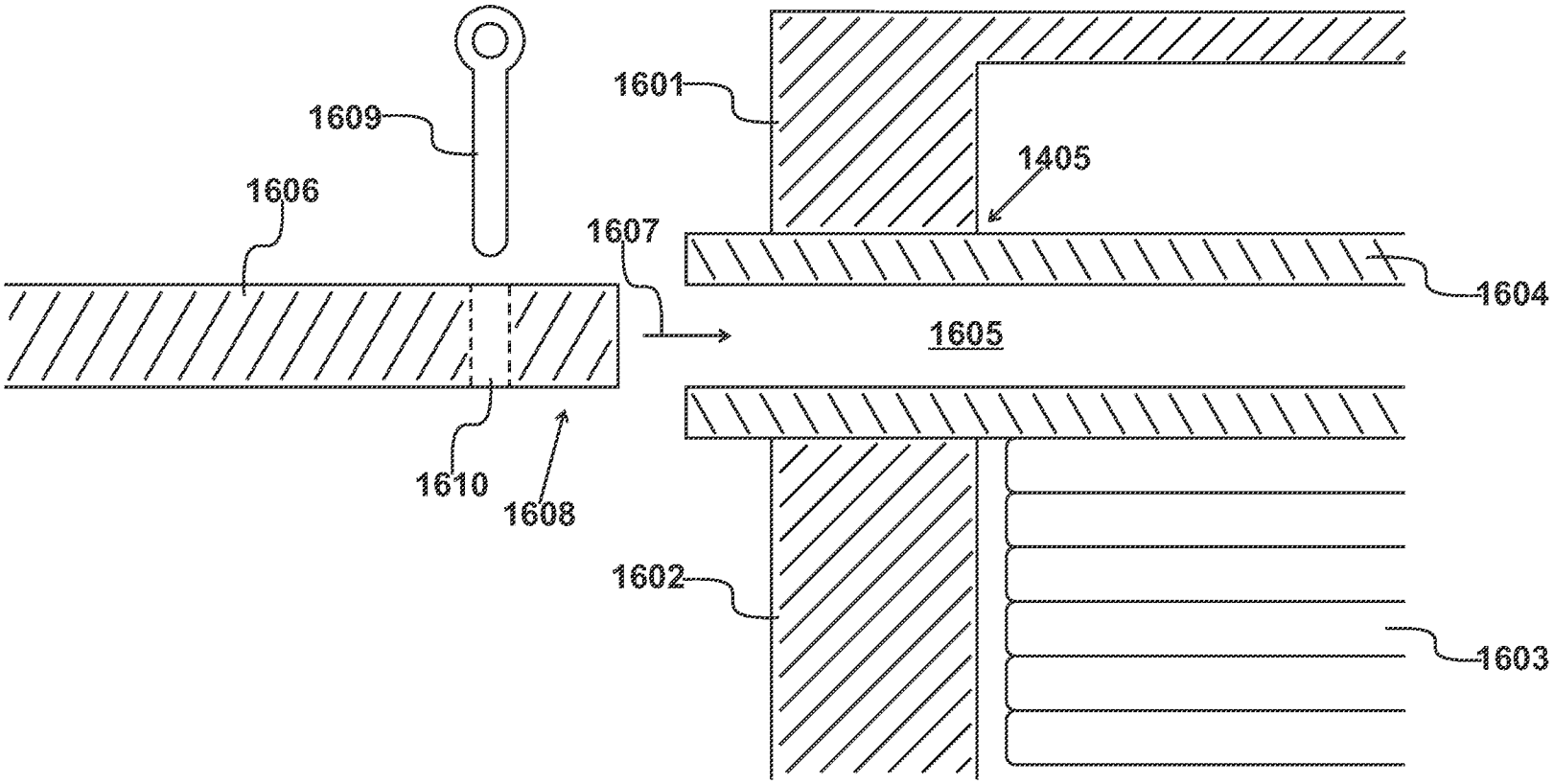
FIG. 16 shows a side view of a stillage identified in FIG. 14.

A side view of a part of the stillage 1401 is illustrated in FIG. 16. This shows a first stillage portion 1601 and a second stillage portion 1602 defining a stillage hole 1405 therebetween.

To retain compressed mattresses 1603, a retention tube 1604 has been inserted within the stillage hole 1405. In this embodiment, each stillage hole 1405, as described with reference to FIG. 14, receives a respective retention tube substantially similar to retention tube 1604.

The retention tubes (including retention tube 1604) only provide a temporary restraining device, of the type described with reference to FIG. 7. The retention tubes form part of the compression device and are therefore retained for the next compression cycle.

To allow the stillage 1401 (containing compressed mattresses) to be removed from the compression device 1301, each internal bore 1605 of a retention tube 1604 receives a respective retention rod. Thus, a retention rod 1606 is inserted within the internal bore 1605 in the direction of arrow 1607.

Each retention rod, such as retention rod 1606, is longer than its respective retention tube, such as tube 1604, such that an end portion 1608 emerges from the opposite end of the retention tube. Furthermore, after removal of the retention tube 1604, a retention pin 1609 is inserted thru a rod hole 1610 in order to secure the retention rod 1606. However, it should be appreciated that other fixings may be used and the end of the retention rod 1606 could be threaded, for example, to receive an appropriate wingnut, in order to achieve a secured configuration.

FIG. 17

After the retention rod 1606 has been fully inserted within the internal bore 1605, the retention tubes, including retention tube 1604, are removed. The mattresses 1603 under compression expand slightly in the direction of arrow 1701 but are still restrained within the stillage due to the presence of the retention rods, including retention rod 1606.

After the removal of the retention tubes, the retention pins 1608 are located within their respective rod holes 1609 to prevent movement of the retention rod in the direction of arrow 1702. Furthermore, a retention head 1703 is provided at the opposite end of each retention pin 1608 to prevent movement of the retention rod 1606 in the direction of arrow 1704.

FIG. 18

Figure 18:
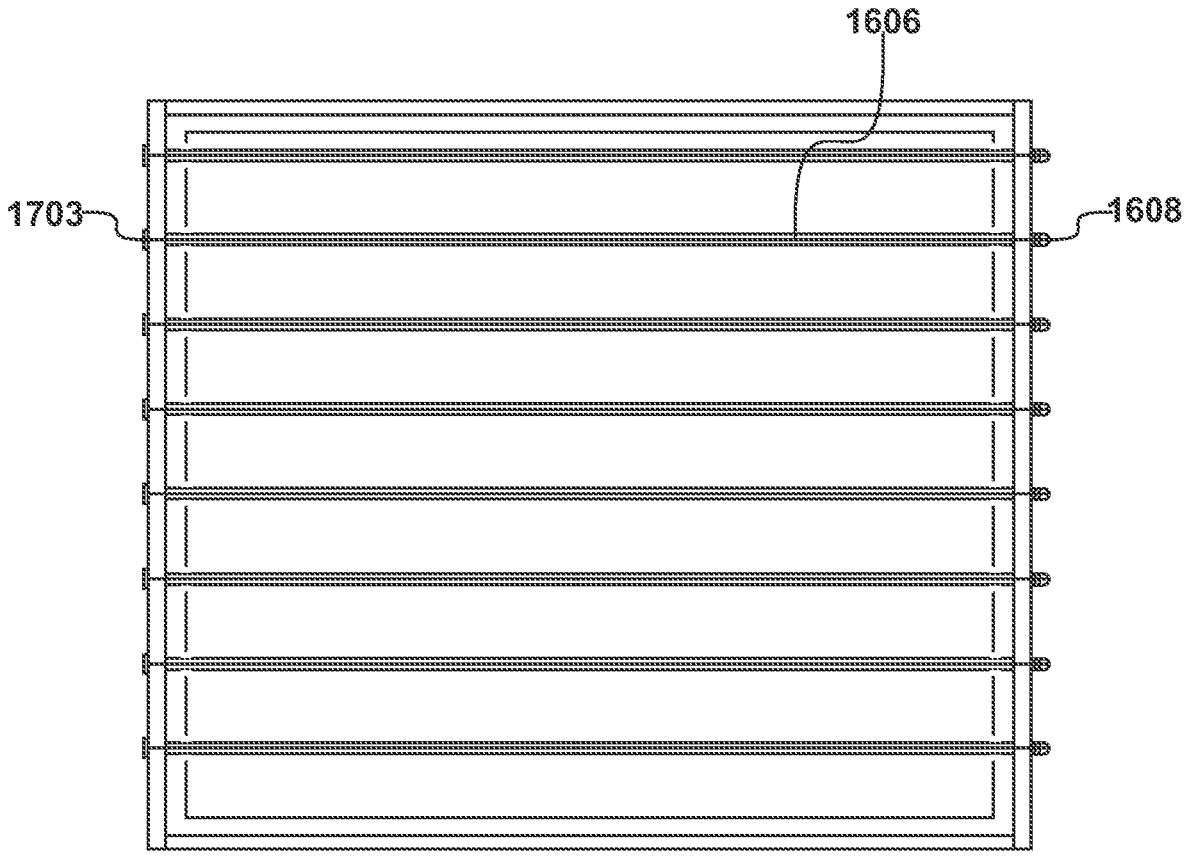
FIG. 18 shows a top view of a secured stillage ready for transportation.

A top view of a secured stillage ready for transportation is illustrated in FIG. 18. In this example, eight retention rods 1606 are in place, although the actual number may vary in order to achieve a required degree of retention while minimising the number of operations required to secure the stillage.

Figure 17:
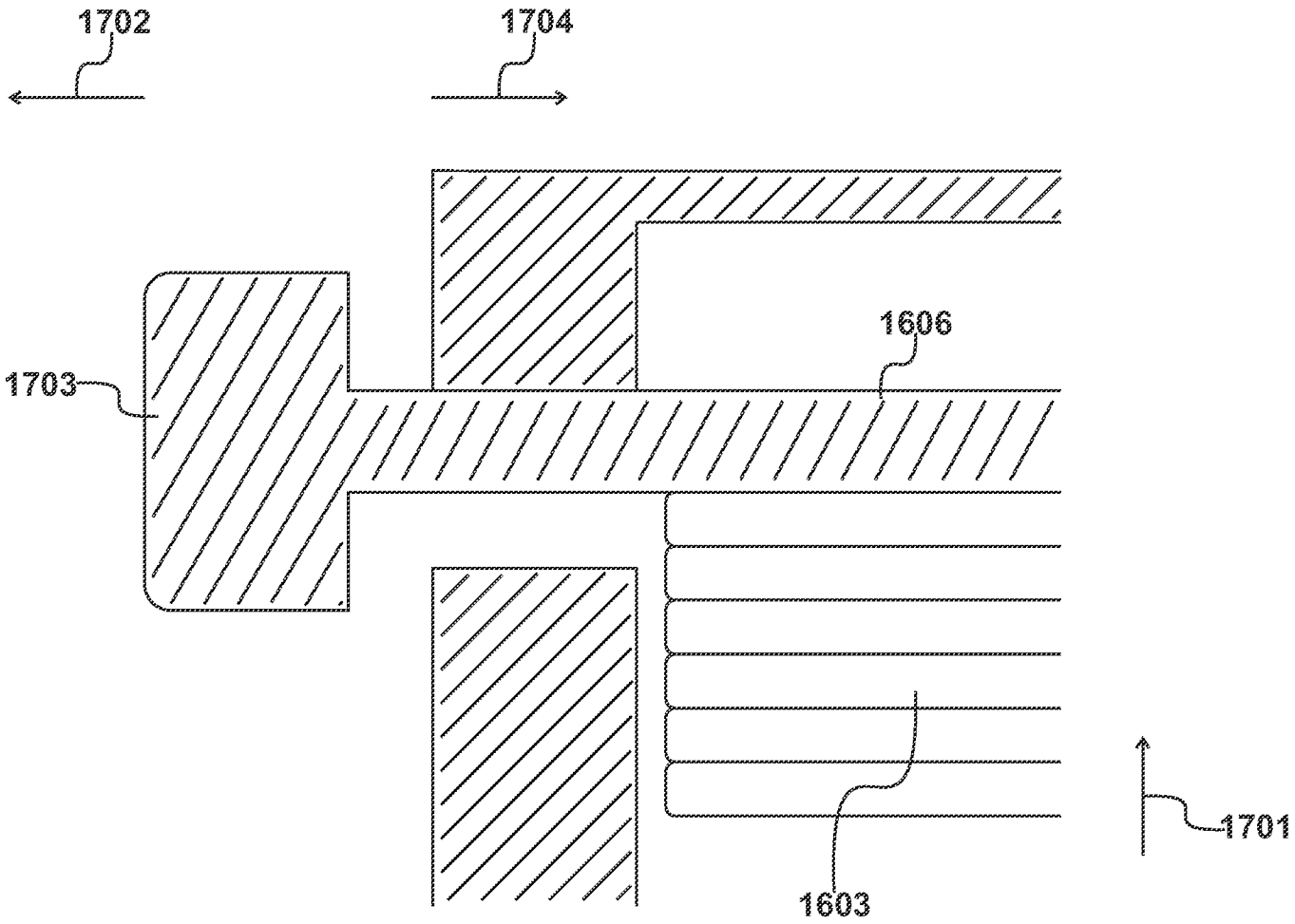
FIG. 17 shows the stillage of FIG. 16 in an alternative configuration.

As previously described with reference to FIG. 17, each retention rod is secured by a retention head 1703 at a first end and a retention pin 1609 at the opposition end.

When retained in a stillage of the type shown in FIG. 18, the compressed mattresses may be transported and stored in the storage buffer 106. If required, the mattresses could be stored for a considerable period of time although, operationally, the storage buffer is provided to even out seasonal variations and is not intended as a long-term storage solution. Furthermore, the stillages are configured to be used repeatedly and, in an embodiment, collapse to occupy a much smaller volume when being stored or transported prior to deployment.

The invention claimed is:

1. An apparatus for compressing mattresses to reduce volume without causing permanent damage, in which each mattress includes a first support surface, a second support surface and a surrounding edge, comprising:

a compression device; and a transportation frame, wherein:

said transportation frame is arranged to receive a mattress stack of said mattresses stacked with said first support surface and said second support surface in contact to a predetermined height;

said compression device is configured to apply additional mattresses, compress said additional mattresses in a direction substantially normal to said first support surface and said second support surface to produce a compressed mattress stack and restrain said compressed mattress stack by a restraining device;

said restraining device includes a plurality of restraining tubes;

said restraining tubes are temporary retraining elements forming part of said compression device;

each said restraining tube has a permanent restraining rod inserted therein, in which each said permanent restraining rod forms part of said transportation frame; and said compressed mattress stack is restrained by said permanent restraining rods after retraction of said restraining tubes.

2. The apparatus of claim 1, wherein said compression device is configured to compress said compressed mattress stack to said predetermined height.

3. The apparatus of claim 1, wherein said compression device is configured to repeatedly add non-compressed mattresses to said compressed mattress stack.

4. The apparatus of claim 1, wherein said restraining device is supported by said transportation frame.

5. The apparatus of claim 1, wherein said restraining device supports non-compressed mattresses.

6. The apparatus of claim 5, wherein said restraining device has a bright finish to facilitate movement of said non-compressed mattresses.

7. The apparatus of claim 4, wherein said restraining device is arranged to be retracted when said compression device is brought into contact with said first support surface.

8. The apparatus of claim 7, wherein said restraining device is arranged to be re-introduced to restrain said compressed mattress stack after a compression cycle.

9. The apparatus of claim 1, wherein said transportation frame includes restraining holes for receiving said restraining tubes.

10. The apparatus of claim 1, wherein said compression device includes restraining channels for accommodating said restraining tubes while maintaining said compressed mattress stack in compression.

11. The apparatus of claim 1, wherein each said permanent restraining rod includes a stop at a first end for abutting against a surface of said transportation frame.

12. The apparatus of claim 11, comprising pins for insertion within one or more holes at a second end of each said permanent restraining rod to thereby secure said permanent restraining rods.

13. The apparatus of claim 1, wherein said transportation frame is collapsible.

14. A method of compressing mattresses to reduce volume without causing permanent damage, in which each mattress includes a first support surface, a second support surface and a surrounding edge, using an apparatus comprising:

a compression device; and a transportation frame, wherein:

said transportation frame is arranged to receive a mattress stack of said mattresses stacked with said first support surface and said second support surface in contact to a predetermined height;

said compression device is configured to apply additional mattresses, compress said additional mattresses in a direction substantially normal to said first support surface and said second support surface to produce a compressed mattress stack and restrain said compressed mattress stack by a restraining device;

said restraining device includes a plurality of restraining tubes;

said restraining tubes are temporary retraining elements forming part of said compression device;

each said restraining tube has a permanent restraining rod inserted therein, in which each said permanent restraining rod forms part of said transportation frame; and said compressed mattress stack is restrained by said permanent restraining rods after retraction of said restraining tubes, wherein said method comprises the steps of:

stacking a plurality of mattresses, with said first support surfaces and said second support surfaces being substantially in contact, to produce said mattress stack;

applying pressure substantially in said direction, such that said pressure is normal to said first support surfaces and said second support surfaces and consistent with pressure applied by a reclining body, thereby resulting in reversible compression to form said compressed mattress stack; and restraining said compressed mattress stack.

15. The method of claim 14, wherein said compressed mattress stack is restrained for transportation purposes.

16. The method of claim 14, wherein said compressed mattress stack is restrained for storage purposes.

17. The method of claim 14, wherein said restraining step includes application of a temporary restraining device during a compression process.

18. The method of claim 17, wherein:

a first plurality of compressed mattresses is restrained by said temporary restraining device;

a second plurality of non-compressed mattresses is placed upon said temporary restraining device;

said compression device is brought into contact with said non-compressed mattresses;

said temporary restraining device is retracted;

said compression device deploys further compression to add said second plurality of non-compressed mattresses to said first plurality of compresses mattresses;

said temporary restraining device is deployed to restrain said compressed mattresses; and said compression device is displaced away from said temporary restraining device.

* * * * *